US007757356B2

(12) United States Patent
Spinks et al.

(10) Patent No.: US 7,757,356 B2
(45) Date of Patent: Jul. 20, 2010

(54) VACUUM-PACKED COIL AND METHOD OF PACKING

(75) Inventors: David J. Spinks, Charlotte, NC (US); Michael D. Noblitt, Shelby, NC (US)

(73) Assignee: Barnhardt Manufacturing Company, Charlotte, NC (US)

( * ) Notice: Subject to any disclaimer, the term of this patent is extended or adjusted under 35 U.S.C. 154(b) by 54 days.

(21) Appl. No.: 12/359,373

(22) Filed: Jan. 26, 2009

(65) Prior Publication Data

US 2009/0133365 A1 May 28, 2009

Related U.S. Application Data

(63) Continuation of application No. 11/562,621, filed on Nov. 22, 2006, now abandoned.

(51) Int. Cl.
*D01G 27/00* (2006.01)

(52) U.S. Cl. ..... 19/159 R

(58) Field of Classification Search ..... 19/157, 19/159 A, 159 R
See application file for complete search history.

(56) References Cited

U.S. PATENT DOCUMENTS

| | | | | | |
|---|---|---|---|---|---|
| 2,764,859 | A * | 10/1956 | Hanselmann | ..... | 53/434 |
| 3,968,877 | A * | 7/1976 | Mattis | ..... | 206/388 |
| 4,179,773 | A * | 12/1979 | Savageau | ..... | 19/159 A |
| 4,261,079 | A * | 4/1981 | Masini et al. | ..... | 19/159 R |
| 5,575,040 | A * | 11/1996 | Leifeld et al. | ..... | 19/159 A |
| 6,425,163 | B1 * | 7/2002 | von Gehlen | ..... | 19/159 R |
| 6,675,442 | B2 * | 1/2004 | Reinehr et al. | ..... | 19/159 R |

* cited by examiner

*Primary Examiner*—Shaun R Hurley
(74) *Attorney, Agent, or Firm*—Adams Intellectual Property Law

(57) ABSTRACT

A method of compressing a cotton strand including the steps of providing an uncompressed strand having an original volume, providing a container adapted to collapse about the strand, feeding the strand into the container, compressing the container to remove a first quantity of air, applying a vacuum to the container to remove a second quantity of air, and sealing the container, wherein the strand is compressed by at least about 25% from its original volume.

17 Claims, 2 Drawing Sheets

VACUUM-PACKED COIL AND METHOD OF PACKING

This is a Continuation Application and claims priority to U.S. patent application Ser. No. 11/562,621 filed Nov. 22, 2006, now abandoned.

BACKGROUND OF THE INVENTION

This invention relates generally to a carded product known as coil and more particularly to cotton, rayon, or polyester coil which has been vacuum packaged. Coil is a non-woven fiber product comprising "sliver" packaged in helical loops. Coil has many uses in various fields, examples of which are pharmaceutical packaging and cosmetology. Coil is a bulky, low-density material which is typically packed into plastic-lined cartons by feeding cotton sliver, which is a continuous, non-twisted strand of loosely assembled fibers, from a production machine into the carton. This is inefficient as a large package volume is required for a commercially practical quantity of material. Furthermore, in some instances the coil as produced does not have the absorbency capacity desired, which requires an excessive amount of the product to be used to obtain the desired absorbency.

BRIEF SUMMARY OF THE INVENTION

Accordingly, it is an object of the invention to provided a method of packing coil more compactly in a container.

It is another object of the invention to provide coil with increased absorbency.

These and other objects are met by the present invention, which in one aspect provides a method of packaging textile coil, including: providing a strand of loosely assembled textile fibers; feeding the strand into a collapsible container; compressing the container so as to cause the container to collapse and compress the strand to a preselected degree; and sealing the container to maintain the strand in a compressed state.

According to another aspect of the invention, the container comprises a substantially impermeable bag.

According to another aspect of the invention, the method further includes placing the container in a relatively rigid outer carton after the step of sealing.

According to another aspect of the invention, the strand comprises cotton sliver.

According to another aspect of the invention, the strand is compressed by at least about 25% of its original volume.

According to another aspect of the invention, the strand is compressed by at least about 50% of its original volume.

According to another aspect of the invention, the step of compressing is carried out by connecting a vacuum source to the container to remove air therefrom.

According to another aspect of the invention, a cotton coil includes cotton sliver which is compressed at least about 25% by volume from its free state.

According to another aspect of the invention, a cotton coil includes cotton sliver which is compressed by at least about 50% of its original volume.

According to another aspect of the invention, a method of protecting a subject's skin during a hair treatment includes: providing textile coil including a strand of loosely assembled textile fibers which has been compressed to a predetermined degree from its original volume; placing the textile coil around a subject's head so as to form a barrier against fluid leakage; and applying a first fluid to subject's head above the textile coil, whereby the first fluid is prevented from contacting the subjects skin below the textile coil.

According to another aspect of the invention, the method further includes applying a second fluid to subject's head above the textile coil, whereby the second fluid is prevented from contacting the subject's skin below the textile coil; and removing the textile coil from the subject's head.

According to another aspect of the invention, the first fluid is a permanent wave hair styling solution, and the second fluid is a neutralizing solution.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
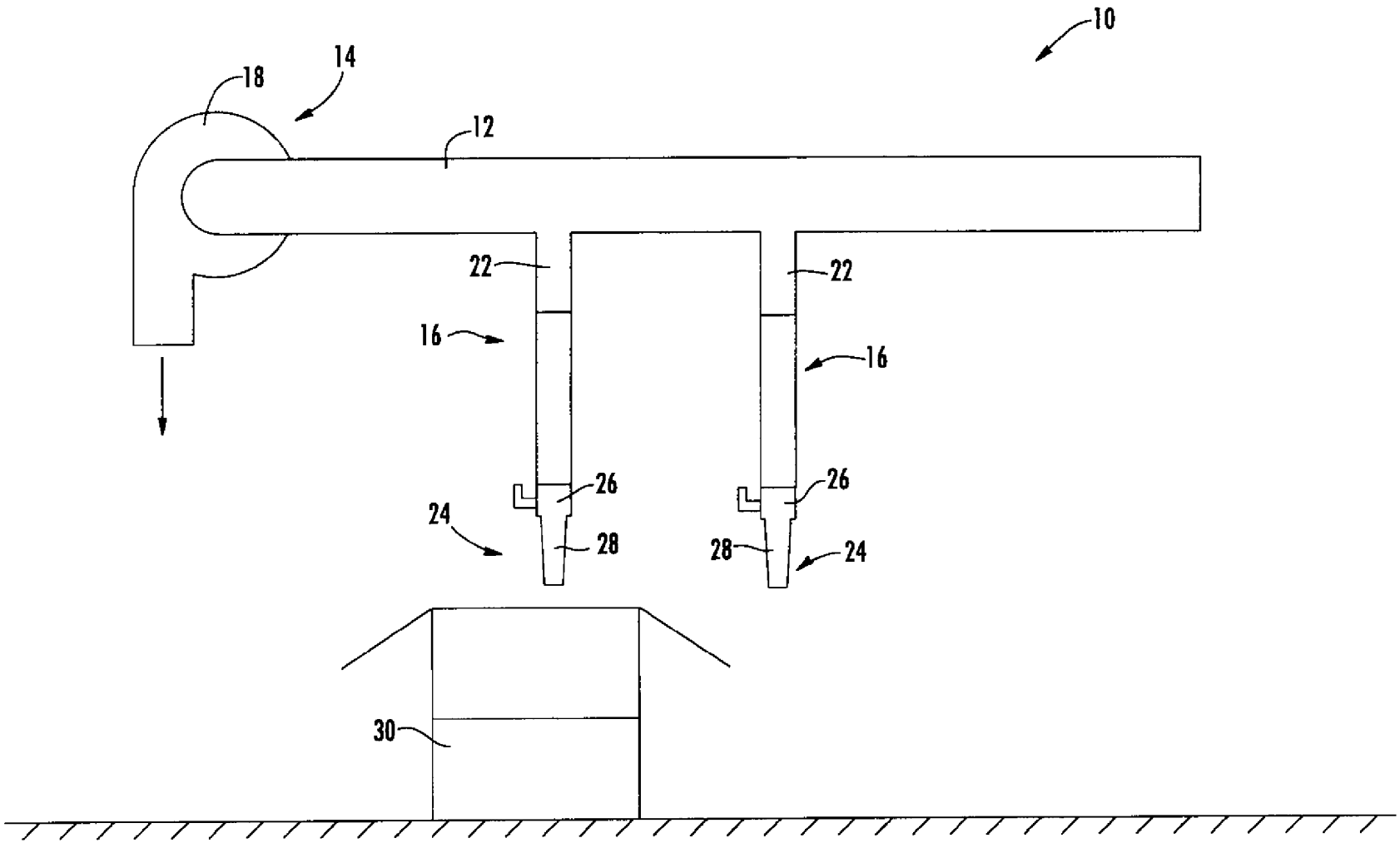
FIG. 1 is a schematic view of a vacuum packaging apparatus constructed in accordance with the present invention.

Referring to the drawings wherein identical reference numerals denote the same elements throughout the various views, FIG. 1 illustrates an exemplary vacuum packing apparatus 10. The packing apparatus 10 includes a vacuum manifold 12 connected to a vacuum source 14, and a plurality of "drops" or vertically-hanging vacuum hoses 16. In the illustrated example the vacuum source 14 comprises a vacuum pump 18 of a known type. Each vacuum hose 16 has an upper end 22 connected to the vacuum manifold 12 and a lower end 24 having a control valve 26 and a nozzle 28 attached thereto. The packing apparatus 10 may be placed in close proximity to an area where containers 30 are loaded with cotton coil.

Figure 2:
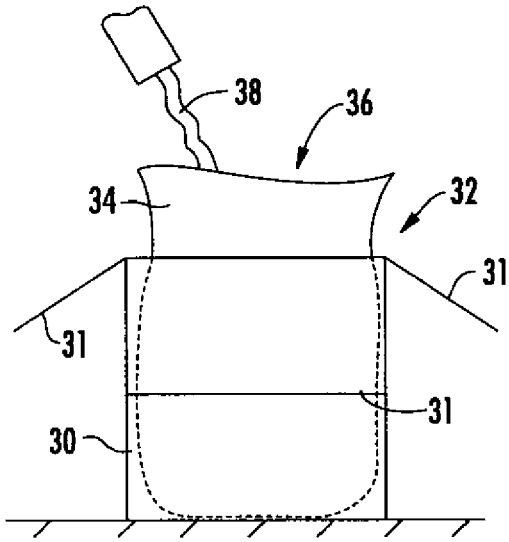
FIG. 2 is a side view of cotton sliver being loaded into a container.
Figure 3:
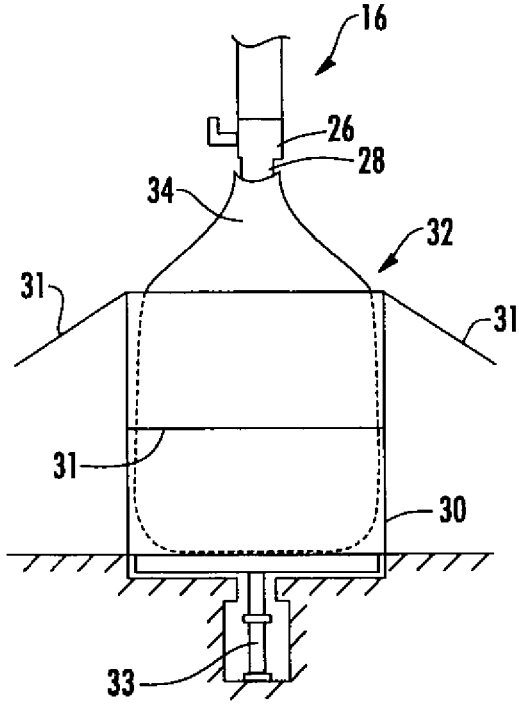
FIG. 3 is a side view of the container of FIG. 2 during a vacuum packing process.
Figure 4:
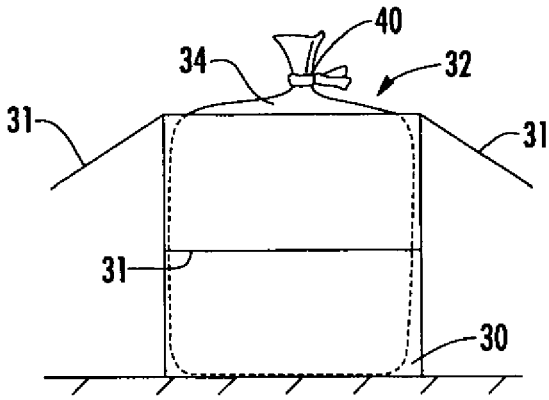
FIG. 4 is a side view of the container of FIG. 3 after the vacuum packing process is complete.

An example of the vacuum packing process is as follows. First, a container 30 such as a cardboard carton is provided with a substantially airtight liner 32, such as the illustrated polyethylene bag, having a top 34 which defines an opening 36. Any kind of package which is capable of collapsing around its contents as a vacuum is applied thereto may be used in place of the liner 32. The lined container 30 is loaded with coil 38 in a known manner (see FIG. 2). The term "coil" is used here in its conventional sense meaning the elongated packaged form of sliver, which is a continuous, non-twisted strand of loosely assembled fibers. Normally, coil 38 is made from materials such as cotton sliver, polyester, or rayon, but other types of fibers could be used as well. The base of the container 30 may be lifted upwards using the illustrated pneumatic cylinder 33 or other appropriate means, while the top of the liner 32 is restrained, to force the majority of the air from the liner 32 and compress the coil 38. This initial compression could also be carried using other types of mechanical devices to compress the liner 32. The nozzle 28 of one of the vacuum hoses 16 is then inserted into the liner 32, and the top 34 of the liner 32 is gathered around the nozzle 28, as shown in FIG. 3. The control valve 26 is then opened while the top 34 of the liner 32 is held tight around the nozzle 28. The reduced pressure in the vacuum hose 16 evacuates the air from the liner 32 and causes atmospheric pressure to compress the liner 32 and the coil 38. The amount of compression is selected by varying the amount of coil 38, the container size, the applied vacuum pressure and time, etc. Once the liner 32 has been compressed to the desired degree, the nozzle 28 is quickly removed and the top 34 of the liner 32 is twisted to prevent air from re-entering the liner 32. A wire tie 40 or other suitable closure is applied to the liner top 34, as shown in FIG. 4. It is also possible to provide a liner (not shown) having a self-sealing port or other means for allowing the vacuum to be applied without requiring additional steps to seal the line. The flaps 31 of the container 30 may then be closed and sealed, for example with tape, adhesives, or staples. When the liner 32 is opened, the coil 38 expands to its original size. It is noted that the liner 32 could also be compressed by mechanical means, for example using a roller or press (not shown).

EXAMPLE 1

Cotton coil of various yard weights was vacuum packaged into containers as described above. Various amounts of the coil were packaged into different size containers. Each combination of quantity and container size corresponded to a different prior art product. In each instance, a given quantity of cotton coil was able to be packaged into a smaller container by using the process described above. Exemplary results of the vacuum packaging are listed in the following tables 1 and 2:

TABLE 1

| Example | Prior Art Container Volume, I (in.$^3$) | New Container Volume, I (in.$^3$) | Length of Product, m (ft.) | Compression (%) |
|---|---|---|---|---|
| 1 | 27.4 (1669.9) | 20.7 (1260.8) | 329.2 (1080) | 24.5 |
| 2 | 27.7 (1691.9) | 20.7 (1260.8) | 402.3 (1320) | 25.5 |
| 3 | 27.7 (1691.9) | 20.7 (1260.8) | 387.1 (1270) | 25.5 |
| 4 | 27.7 (1691.9) | 20.7 (1260.8) | 307.8 (1010) | 25.5 |
| 5 | 27.7 (1691.9) | 20.7 (1260.8) | 420.6 (1380) | 25.5 |
| 6 | 27.4 (1669.9) | 20.7 (1260.8) | 310.9 (1020) | 24.5 |

TABLE 2

| Example | Prior Art Container Volume, I (in.$^3$) | New Container Volume, I (in.$^3$) | Net Weight of Product, Kg (lbs.) | Compression (%) |
|---|---|---|---|---|
| 7 | 162.8 (9937.1) | 102.6 (6261.8) | 9.8 (22) | 37.0 |
| 8 | 204.7 (12,492.1) | 129 (7871.8) | 9.8 (22) | 37.0 |

As can be seen from Tables 1 and 2, vacuum packaging according to the present invention reduced container volume at least about 25% for the same quantity of product. In another example, cotton coil was vacuum packaged into a fixed size container using the method described above. The results of the vacuum packaging are listed in the following table 3:

TABLE 3

| Example | Container Volume, I (in.$^3$) | Prior Art Weight of Product, Kg (lbs.) | New Weight of Product, Kg (lbs.) | Compression (%) |
|---|---|---|---|---|
| 9 | 159.7 (9745.2) | 5.4 (12.0) | 10.9 (24.0) | 50.0 |

As can be seen from Table 3, vacuum packaging according to the present invention enabled a greater quantity of cotton coil to be packed into the same size container as the prior art product, with an effective compression of about 50%. Thus, the present vacuum packing method, by increasing packing density, has the flexibility to package a given quantity of material in a smaller package, or to increase the quantity of product in a given container volume. This saves packaging, transportation, and warehousing costs.

EXAMPLE 2

A comparative test was performed between prior art cotton coil and cotton coil produced according to the present invention, in a cosmetological application. For each trial, a control test was performed. Approximately two wraps of prior art cotton coil were placed around the head of a subject, following the subject's hairline. A suitable quantity of a known chemical solution used for permanent wave hair styling, known as "perm solution", was applied to the hair. Perm solution is irritating and harmful to skin and thus it is desirable that it touches only the subject's hair and scalp. On average, approximately 27 ml (two tablespoons) of the perm solution dripped past the cotton coil onto the forehead of the subject. After the perm solution remained for the required period of time, the original cotton coil was removed and replaced with approximately two more wraps of prior art cotton coil around the head. A suitable quantity of a known neutralizing solution was then applied to the head. Again, on average about 27 ml (two tablespoons) of the neutralizing solution dripped passed the cotton coil onto the forehead of the subject.

Trials were then performed using cotton coil made according to the present invention. For each trial, approximately one full wrap of cotton coil packaged according to the present invention was placed around the head of a subject, following the hairline. The same quantity as was used in the control test of a known chemical solution used for permanent wave hair styling, known as "perm solution", was applied to the hair. None of the perm solution dripped past the cotton coil onto the forehead of the subject. After the perm solution remained for the required period of time, the cotton coil was found to be dry and in good condition, and therefore could be reused. The same quantity as was used in the control test of a known neutralizing solution was then applied to the head, with the original wrap of cotton coil in place. Again, none of the neutralizing solution dripped passed the cotton coil onto the forehead of the subject.

Over 200 trials were performed for the comparative tests described above. Each trial included both a control trial and an inventive trial as described above. The above-noted results were found consistently in each trial. Thus, the cotton coil made according the present invention requires approximately one-quarter of the material required for prior art cotton coil in a beauty application, and lasts approximately twice as long as the prior art coil in the same application.

The foregoing has described a vacuum-packed cotton coil and a method for producing the coil. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A method of condensing a continuous strand of loosely assembled cotton fibers into a compressed state, comprising the steps of:

(a) providing a continuous strand of loosely assembled cotton fibers having an original volume;

(b) providing an airtight container adapted to collapse about the strand as a vacuum is applied thereto;

(c) feeding the strand into the container;

(d) compressing the strand in the container comprising the steps of:

(i) moving a first portion of the container relative to a second portion of the container to compress the container and remove a first quantity of air from the container to cause the container to collapse and compress the strand therein; and (ii) subsequently removing a second quantity of air from the container by applying a vacuum to the interior of the container to further compress the container and the strand therein; and (e) sealing the container to maintain the container and the strand in the compressed state;

wherein the strand is compressed by at least about 25% from its original volume.

2. The method according to claim 1, wherein the continuous strand of loosely assembled cotton fibers are non-twisted.

3. The method according to claim 1, wherein the strand maintains at least a portion of the applied compression when removed from the container.

4. The method according to claim 1, wherein the strand is compressed by at least about 50% from its original volume.

5. The method according to claim 1, wherein the step of moving a first portion of the container relative to a second portion of the container includes restraining the top of the container while lifting the base of the container toward the top of the container.

6. The method according to claim 5, wherein the top of the container is restrained by attachment to a nozzle of a vacuum hose.

7. The method according to claim 1, wherein the container is an airtight bag.

8. The method according to claim 1, wherein the container is a carton including an airtight liner.

9. The method according to claim 1, wherein the continuous strand is not combed, drawn, roved or ring spun.

10. The method according to claim 1, wherein the continuous strand is cotton sliver.

11. A method of compressing cotton sliver, comprising the steps of:

(a) providing an uncompressed continuous strand of cotton sliver having an original volume;

(b) providing a container adapted to collapse about the continuous strand of cotton sliver as air is removed from the container;

(c) feeding the strand into the container;

(d) compressing the container to remove a first quantity of air from the container;

(e) removing a second quantity of air from the container by applying a vacuum to the interior of the container; and (f) sealing the container to maintain the container and the strand in a compressed state;

wherein the strand is compressed by at least about 25% from its original volume.

12. The method according to claim 11, wherein the cotton sliver is a non-twisted strand of loosely assembled fibers.

13. The method according to claim 11, wherein the strand maintains at least a portion of the applied compression when removed from the container.

14. The method according to claim 11, wherein the strand is compressed by at least about 50% from its original volume.

15. The method according to claim 11, wherein the step of compressing the container to remove a first quantity of air further comprises restraining the top of the container while lifting the base of the container toward the top of the container.

16. The method according to claim 15, wherein the top of the container is restrained by attachment to a nozzle of a vacuum hose.

17. The method according to claim 11, wherein the cotton sliver is not combed, drawn, roved or ring spun.

* * * * *